US009364854B2

(12) United States Patent
Ohnishi

(10) Patent No.: US 9,364,854 B2
(45) Date of Patent: Jun. 14, 2016

(54) PRINTING METHOD AND PRINTING SYSTEM

(75) Inventor: Masaru Ohnishi, Tomi (JP)

(73) Assignee: MIMAKI ENGINEERING CO., LTD., Tomi, Nagano (JP)

( * ) Notice: Subject to any disclaimer, the term of this patent is extended or adjusted under 35 U.S.C. 154(b) by 40 days.

(21) Appl. No.: 14/241,447

(22) PCT Filed: Sep. 11, 2012

(86) PCT No.: PCT/JP2012/073234

§ 371 (c)(1),
(2), (4) Date: Feb. 27, 2014

(87) PCT Pub. No.: WO2013/039077

PCT Pub. Date: Mar. 21, 2013

(65) Prior Publication Data

US 2014/0220254 A1 Aug. 7, 2014

(30) Foreign Application Priority Data

Sep. 12, 2011 (JP) ..... 2011-198893

(51) Int. Cl.

| | |
|---|---|
| ***B05D 3/06*** | (2006.01) |
| ***B41J 2/005*** | (2006.01) |
| ***B41M 5/035*** | (2006.01) |
| ***B41M 7/00*** | (2006.01) |
| ***B41M 5/025*** | (2006.01) |
| ***B41M 1/40*** | (2006.01) |
| ***B41M 5/03*** | (2006.01) |
| ***B05D 1/28*** | (2006.01) |

(52) U.S. Cl.

CPC *B05D 3/067* (2013.01); *B05D 1/28* (2013.01); *B41J 2/0057* (2013.01); *B41M 1/40* (2013.01); *B41M 5/0256* (2013.01); *B41M 5/03* (2013.01); *B41M 5/035* (2013.01); *B41M 7/0081* (2013.01)

(58) Field of Classification Search

CPC ..... B41M 3/12; D06P 5/00
USPC ..... 427/146; 8/471
See application file for complete search history.

(56) References Cited

U.S. PATENT DOCUMENTS 4,614,521 A * 9/1986 Niwa ..... B41M 5/385 347/172

FOREIGN PATENT DOCUMENTS

| | | | |
|---|---|---|---|
| CN | 101338528 | A | 1/2009 |
| CN | 103459160 | A | 12/2013 |
| EP | 1808303 | A1 | 7/2007 |
| EP | 1870247 | A1 | 12/2007 |

(Continued)

OTHER PUBLICATIONS

International Search Report in International Application No. PCT/JP2012/073234, dated Nov. 6, 2012.

(Continued)

*Primary Examiner* — Andrew Bowman
(74) *Attorney, Agent, or Firm* — Park, Kim & Suh, LLC

(57) ABSTRACT

A printing method according to the present invention includes an applying step of applying a curable resin-containing ink onto a transfer sheet (10), a heating and thickening step of heating the ink on the transfer sheet (10) to increase viscosity of the ink, a transfer step of transferring the ink on the transfer sheet (10) to a printing target (15), and a curing step of curing the ink on the printing target (15).

9 Claims, 3 Drawing Sheets

(56) References Cited

FOREIGN PATENT DOCUMENTS

| | | | | | |
|---|---|---|---|---|---|
| EP | 2546058 | A1 | | 1/2013 | |
| EP | 2692535 | A1 | | 2/2014 | |
| JP | 6-8697 | A | | 1/1994 | |
| JP | 10-202998 | A | | 8/1998 | |
| JP | 2004-359761 | A | | 12/2004 | |
| JP | 2006-130725 | A | | 5/2006 | |
| JP | 2007-331794 | A | | 12/2007 | |
| JP | 2010143073 | | * | 2/2010 | ..... B41M 3/12 |
| JP | 2010-143073 | A | | 7/2010 | |
| JP | 2011-16298 | A | | 1/2011 | |
| KR | 10-2007-0042915 | A | | 4/2007 | |

OTHER PUBLICATIONS

Korean Office Action in Appln. No. 10-2014-7005284 dated Apr. 21, 2015.
Japanese Office Action in Appln. No. 2011-198893 dated Oct. 29, 2014.
Chinese Office Action in Appln. No. 201280044425.1 dated Oct. 23, 2014.
European Search Report in Appln. No. 12831489.5 dated Apr. 7, 2015.
Korean Final Rejection in Appln. No. 10-2014-7005284 dated Oct. 30, 2015 with English translation.
Korean Final Rejection in Appln. No. 10-2014-7005284 dated Feb. 25, 2016 with English translation.

* cited by examiner

PRINTING METHOD AND PRINTING SYSTEM

CROSS-REFERENCE TO RELATED APPLICATIONS

This application is the National Stage filing under 35 U.S.C. 371 of International Application No. PCT/JP2012/073234, filed on Sep. 11, 2012, which claims the benefit of Japanese Patent Application No. 2011-198893, filed on Sep. 12, 2011, the contents of which are all hereby incorporated by reference herein in their entirety.

TECHNICAL FIELD

The present invention relates to a printing method and a printing system.

BACKGROUND ART

An inkjet offset printing method is described in Patent Document 1. The method described in this publication includes a first step of printing a UV ink image on a flat original sheet by using inkjet printing with a UV ink, a second step of irradiating the UV ink image with UV or an electron beam to bring the UV ink image to a semi-dry state while the UV ink image is being printed or immediately after the UV ink image is printed, a third step of transferring the semi-dry UV ink image to an elastic blanket surface, a fourth step of offset printing the transferred UV ink image from the elastic blanket to a printing object, and a step of drying and fixing the UV ink image formed by the offset printing.

CITATION LIST

Patent Literature

PTL 1: JP-A-2006-130725 (published May 25, 2006)

SUMMARY OF INVENTION

Technical Problem

In the foregoing conventional technique, the second step of bringing the UV ink to a semi-dry state immediately after the printing involves UV irradiation that makes the ink viscosity 0.1 to 300 PaS in terms of a standard UV ink viscosity at 25° C.

However, the printed image quality is limited in the offset printing (pad printing) when the first step of printing a UV ink image on a flat original sheet is performed by multi-pass printing, and when the second step is performed while printing the UV ink image.

The present inventors diligently worked to find the cause of this drawback, and identified the following finding. In the technique described in Patent Document 1, the portion printed first is exposed to more UV light than the subsequently printed portions when the print is made in the multi-pass mode. Accordingly, the extent of curing differs for each pass of the printed UV ink, and the ink transfer characteristics vary greatly. The result is that a stable, high-image-quality printing result cannot be obtained.

It is accordingly an object of the present invention to provide a printing method that enables a stable, high-image-quality printing result to be obtained in offset printing that uses a curable resin-containing ink such as a UV ink in multi-pass printing.

Solution to Problem

In order to solve the foregoing problem, a printing method according to the present invention includes:

an applying step of applying a curable resin-containing ink onto a transfer sheet;

a heating and thickening step of heating the ink on the transfer sheet to increase viscosity of the ink;

a transfer step of directly or indirectly transferring the ink on the transfer sheet to a printing target; and a curing step of curing the ink on the printing target.

With this configuration, a stable, high-image-quality printing result can be obtained in digital printing that uses a curable ink such as a UV ink in multi-pass printing.

Further, with the foregoing configuration, a stable, high-image-quality printing result can be obtained in offset printing that uses a curable ink such as a UV ink in multi-pass printing or one-pass inkjet printing.

A printing system according to the present invention includes:

applying means that applies a curable resin-containing ink onto a transfer sheet;

heating means that dries the ink on the transfer sheet to increase viscosity of the ink;

transfer means that directly or indirectly transfers the ink on the transfer sheet to a printing target; and curing means that cures the ink on the printing target.

With this configuration, stable, high-image-quality printing can be performed in offset printing that uses a curable resin-containing ink such as a UV ink in multi-pass printing. Further, stable, high-image-quality printing can be performed more desirably when the ink is a solvent-diluted UV ink.

Other objects, features, and advantages of the present invention will be more clearly understood from the following descriptions. The advantages of the present invention will be apparent from the following descriptions taken in conjunction with the accompanying drawings.

Advantageous Effects of Invention

An advantage of the present invention is that a stable, high-image-quality printing result can be obtained in offset printing that uses a curable resin-containing ink such as a UV ink in multi-pass or one-pass inkjet printing.

DESCRIPTION OF EMBODIMENTS

Figure 1:
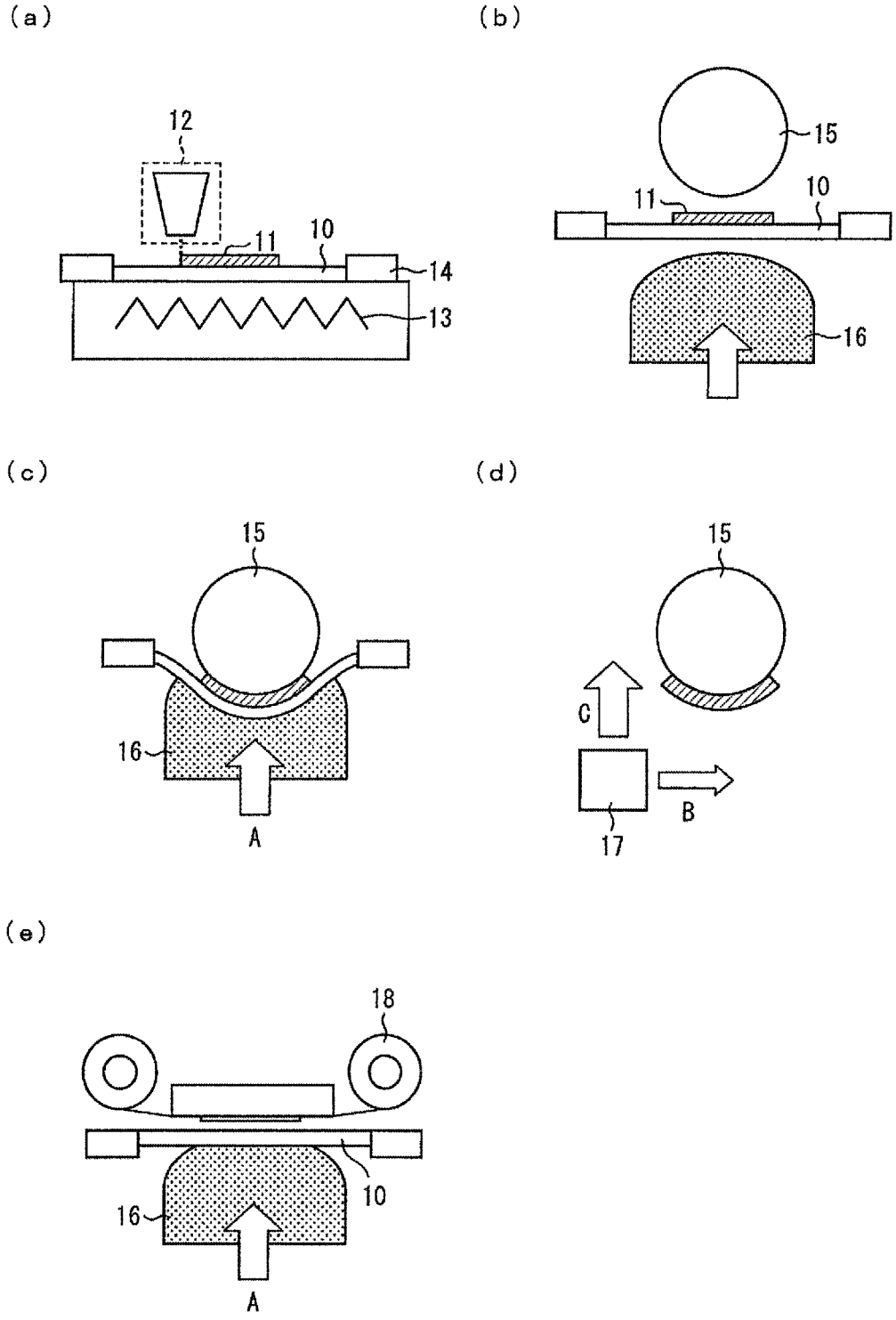
FIG. 1 is a diagram schematically representing a printing method according an embodiment of the present invention.

Embodiments of the present invention are described below in detail.

A printing method according to the present invention includes an applying step of applying a curable resin-containing ink onto a transfer sheet, a heating and thickening step of heating the ink on the transfer sheet to increase the viscosity of the ink, a transfer step of directly or indirectly transferring the ink on the transfer sheet to a printing target, and a curing step of curing the ink on the printing target.

In the present invention, the original sheet (transfer sheet) is heated to bring the printed image (ink) to a dry state on the original sheet. This is in contrast to the related art in which the UV ink is brought to a semi-dry state by irradiation, whereas the ink is heated to dry in the present invention.

The mechanism by which the UV ink is partially cured to achieve the semi-dry state by UV irradiation is the crosslinking of monomer (resin formation). On the other hand, the mechanism involved in the heating of an original sheet is the evaporation of components other than the curable resin, for example, such as a solvent, and/or the thermal curing of the curable resin itself. With this mechanism, the contents of components (e.g., solvent) other than the curable resin do not differ greatly in the portion printed first and the subsequently printed portions, and become more uniform in these printed portions. Accordingly, the efficiency at which components (e.g., solvent) other than the curable resin are removed by drying, and/or the extent of the thermal curing of the curable resin itself in response to drying tend to be more uniform in the first and the subsequent printed portions, and the transfer characteristics become less variant. A stable, high-image-quality printing result can thus be obtained in printing (for example, pad printing) that uses a curable resin-containing ink such as a UV ink in multi-pass printing. The method according to the present invention is also applicable to one-pass inkjet printing.

As used herein, "curable resin" refers to resins that cure in response to external stimuli. For example, the curable resin is a high-viscosity resin that contains a monomer and/or an oligomer, and that cures under energy rays such as ultraviolet light (hereinafter, also referred to simply as "UV"). Specific examples include ultraviolet curable resins that cure upon exposure to ultraviolet light, electron beam curable resins that cure upon exposure to an electron beam, heat curable resins (such as epoxy resin) that cure under heat, and heat-dry curable resins (such as a latex ink, and a solvent ink) that cure by being dried. When using heat-dry curable resins such as a latex ink and a solvent ink, the heating and thickening step and the curing step (described later) may be performed by heating the ink to dry.

Examples of the curable resin-containing ink include a solvent-diluted ink containing a curable resin and a solvent. For example, when the curable resin-containing ink is an ink containing a high-viscosity UV curable resin and a solvent, drying the ink by evaporating the solvent in the heating and thickening step leaves the UV curable resin and increases viscosity, and irradiation of the ink with ultraviolet light in the curing step cures the UV curable resin and thus the ink. Such an ink containing a curable resin and a solvent makes it easier to perform the heating and thickening step and the curing step.

The UV curable resin may be a cation polymerizable resin, a radical polymerizable resin, or a mixture of these. The UV curable resin may have a viscosity as may be decided according to the intended purpose, and may be, for example, a low-viscosity or high-viscosity monomer or oligomer. For example, the viscosity is 30 mPa·sec or more, preferably 40 mPa·sec or more, more preferably 100 mPa·sec or more, and 200,000 mPa·sec or less, preferably 100,000 mPa·sec or less, more preferably 1,000 mPa·sec or less.

The solvent may be appropriately decided according to, for example, the type of the curable resin.

As a specific method of the applying step, any method may be used that applies an ink onto a transfer sheet, and, for example, an inkjet method may be used. As an example, the applying step may be a step in which a solvent-diluted ink of reduced viscosity for ejection through an inkjet head is applied onto a transfer sheet.

The ink may have a viscosity as may be decided according to the intended purpose. Preferably, the viscosity is 3 mPa·sec to 40 mPa·sec, more preferably 20 mPa·sec or less at 25° C. in the state before the heating and thickening step. This is to make the ejection of the ink through an inkjet head easier.

Preferably, the heating and thickening step thickens the ink to a viscosity of preferably 30 mPa·sec or more, more preferably 40 mPa·sec or more, and preferably 100,000 mPa·sec or less, more preferably 10,000 mPa·sec or less. With these viscosity ranges, the ink can have a form of a liquid or a paste with a sufficiently high viscosity that does not cause bleeding, and that provides adhesion preferable for transfer.

As a specific method of the heating and thickening step, for example, the ink may be heated to dry and increase viscosity by evaporating the water content in the curable resin. For example, the heating and thickening step is a step of heating the solvent-diluted ink to evaporate the ink solvent and increase viscosity.

In the printing method according to the present invention, the solvent content with respect to the total ink amount when the ink contains a solvent may be appropriately decided according to the intended purpose, and is preferably 20 weight % to 95 weight %. With this range, the drying can remove 80% of the solvent, and increase the ink viscosity. The foregoing range is also preferable from the standpoint of providing glossiness for the printed surface.

The ink color is not limited, and the ink may have ordinary colors, for example, such as Y (yellow), M (magenta), C (cyan), and K (black), or various other colors, including, for example, specific colors such as pale shades of these ordinary colors, white, metallic, clear, and combinations of these.

Various materials may be used for the transfer sheet according to the intended purpose. Preferably, the transfer sheet is made of an elastic material to make the transfer easier when the printing target has a non-flat surface such as a curved surface. More preferably, the material of the transfer sheet is one that can deform along the shape of the printing surface of the printing target. More specifically, for example, a silicon rubber may preferably be used as the material of the transfer sheet. Other than silicon rubber, rubbers and elastomer resins such as fluoro rubber, butyl rubber, chloroprene rubber, urethane rubber, butadiene rubber, neoprene, and EPDM may be used either alone, or in combination as a composite material, as may be decided according to the intended purpose. Further, fillers such as talc, metal oxide, glass powder, resin powder, and fiber may be added to vary the sheet elasticity or hardness. By using these materials, the inked surface of the transfer sheet can be transferred to the printing target by being directly pressed against the printing target in contact with the transfer sheet. This makes it easier to perform the transfer step.

When the transfer sheet is disposable, the transfer sheet may be made of a material that does not restore its shape, instead of using a material, such as rubber, that returns to the original shape when the applied pressure is removed. Examples of such non-restoring materials include thermoplastic thin resin films such as a laminate film.

The hardness and the thickness of the transfer sheet may be appropriately varied according to the shape of the printing target. For example, the transfer sheet preferably has lower hardnesses and thinner thicknesses as the shape of the printing target becomes more complex. When the printing target is a flat plate, the transfer sheet may have a form of a rubber plate.

When directly pressing the transfer sheet against the printing target, it is preferable to apply pressure from the opposite side from the inked surface with a pressing member such as a pad (transfer means; hereinafter, simply "pad") of a shape that can evenly apply pressure. In this way, the ink can transfer under the force of more evenly distributed pressure.

When a UV curable ink diluted with a solvent is used, it is possible to use a method that transfers the ink from the transfer sheet to a bracket, and prints the bracket to a printing target. However, this may involve cooling of the ink when the warmed ink on the transfer sheet is transferred to the bracket, and to the printing target. In other words, there are cases where the ink transfer temperature varies at the time of the transfer to the bracket and the transfer to the printing target, and varies the transfer rate. This can be preferably avoided by the direct transfer from the transfer sheet to the printing target.

In the transfer step, the high-viscosity ink on the transfer sheet is directly or indirectly transferred to the printing target. The transfer from the transfer sheet to the printing target may be direct or indirect in the transfer step. However, the direct transfer is more preferable for the reasons described above. Note that "direct transfer" means directly pressing and contacting the transfer sheet to the printing target, whereas "indirect transfer" involves a transfer from the transfer sheet to an object such as a bracket, and to the printing target. More than one such object may be used. However, the number of objects should preferably be as small as possible from the standpoint of transfer rate.

The transfer step may be performed at room temperature. However, for more stable transfer, the transfer step may be performed under adjusted temperature conditions such as by insulation or heating to provide a constant transfer environment or constant film flexibility.

The transfer may be performed color by color, or in full color, for example, by transferring a two-color, four-color, or six-color printed image at once.

There is a viscosity gradient in the ink because the drying of the ink proceeds from the surface in the heating and thickening step performed before the transfer step. Specifically, the viscosity of the ink is higher on the side of the ink surface in contact with the transfer sheet than on the ink applied surface side. Because of the viscosity gradient, the ink is desirably transferred to the transfer sheet.

In the curing step, the ink may be cured by appropriately using a method as may be decided according to the type of the ink. For example, when the ink is a UV curable ink, the ink may be irradiated with UV with a UV irradiator at UV wavelengths that can reach inside of the ink.

Embodiment 1

An embodiment of the printing method according to the present invention is described below with reference to FIG. 1. FIG. 1 is a diagram schematically representing the printing method according to the present embodiment.

The present embodiment will be described through the case where the ink is a UV curable ink prepared by diluting a UV curable resin with a solvent.

As illustrated in (a) of FIG. 1, an inkjet head (applying means) 12 is used to apply the UV curable ink onto a transfer sheet 10 of a material such as silicon rubber on a flat plate (applying step). The transfer sheet 10 is attached to a holder 14 to maintain flatness, and improve operability.

Thereafter, a heater (heating means) 13 is used to heat and dry the ink on the transfer sheet 10 by evaporating the solvent (heating and thickening step). Here, the solvent is evaporated to adjust viscosity to such an extent that the ink does not bleed, and maintains adhesion sufficient to enable transfer. As a result, a temporarily cured print image 11 is formed on the transfer sheet 10. Note that the term "temporary cure" is used to refer to the state where the solvent has evaporated to increase the viscosity of the ink.

The heater 13 may be realized by various means, including, for example, a ceramic heater, a tungsten heater, a sheathed wire heater, a far infrared heater, an IH heater, a hot-air heater, and combinations of these.

The heating temperature by the heater 13 is, for example, preferably 40° C. to 70° C. for 5 seconds to 5 minutes, more preferably 1 minute or less.

For ease of ejection through the head, the viscosity of the solvent-diluted UV curable ink in the present embodiment is preferably 3 mPa·sec to 40 mPa·sec at room temperature, more preferably 20 mPa·sec or less. The heating and thickening step by the heater 13 may thicken the ink to, for example, a viscosity of 30 mPa·sec or more, more preferably 40 mPa·sec or more, and, for example, 200,000 mPa·sec or less, more preferably 100,000 mPa·sec or less, further preferably 10,000 mPa·sec or less. With these viscosity ranges, the UV curable ink can have a form of a liquid or a paste with a sufficiently high viscosity that does not cause bleeding, and that provides adhesion preferable for transfer.

Thereafter, the transfer sheet 10 is moved between a printing target 15 and a pad (transfer means) 16, as illustrated in (b) of FIG. 1. In the present embodiment, the printing target 15 is shown as a simple sphere. However, the shape of the printing target used for printing by the printing method according to the present invention is not limited to this, and various shapes of printing target may be used for printing.

As illustrated in (c) of FIG. 1, the pad 16 is pressed in the direction of arrow A to bring the surface (surface with the temporarily cured print image 11) of the transfer sheet 10 into contact with the printing surface of the printing target 15. This transfers the temporarily cured print image 11 to the printing target 15 (transfer step).

The applied pressure flattens the temporarily cured print image 11. The drawback of inkjet printing using a UV curable ink, specifically the matting problem that removes glossiness from surface can be overcome, and a high glossy image can be obtained. If a matte look is desired, a matte surface may be provided for the transfer sheet 10.

The pad 16 is preferably made of an elastic material, more preferably a material that can evenly apply pressure to the target. Examples of possible materials include a soft rubber, a hard rubber, a sponge, and a bag filled with liquid, powder, or gas. It is also possible to use materials such as metal, pursuit, wood, and felt when the transfer sheet has a form of a flat plate as in Embodiment 3 to be described later.

Thereafter, as illustrated in (d) of FIG. 1, a UV irradiator (curing means) 17 is moved in the direction of arrow B as the UV irradiator 17 irradiates the temporarily cured print image 11 on the printing target 15 with ultraviolet light in the direction of arrow C. The irradiation cures the whole temporarily cured print image 11 on the printing target 15 (curing step). The cure by the curing step will be referred to as "permanent cure" to distinguish it from the cure that increases viscosity in the heating and thickening step.

Examples of the specific configuration of the UV irradiator 17 include a UV-LED lamp, a metal halide lamp, a black light, a sterilizing lamp, a xenon lamp, and combinations of these. The UV-LED wavelength may be, for example, 350 nm to 410 nm.

For any subsequent printing, a cleaning sheet 18 is used to clean the transfer sheet 10, as illustrated in (e) of FIG. 1. For example, the cleaning sheet 18 is slid to wipe away any remaining ink, dust, and other materials from the transfer sheet 10 under the pressure of the pad 16 pressed in the direction of arrow A. The transfer sheet 10 and the pad 16 may be washed with the use of an alcohol or the like.

An advantage of the present embodiment is the ease of control of transfer rate. When a solvent-diluted UV curable ink is used, the ink may be transferred from the transfer sheet to a bracket, and to the printing target, as noted above. However, this may involve cooling of the ink when the warmed ink on the transfer sheet is transferred to the bracket, and to the printing target. It is therefore more preferable to directly transfer the ink from the transfer sheet to the printing target as in the present embodiment, because it can suppress a temperature drop of the ink.

The present embodiment does not require fabrication of a printing plate, and can print on a variety of curved surfaces in small volumes, both quickly and at low cost. Further, because only a single transfer is required, less color misalignment and less bleeding occur in the transfer as compared to the conventional pad printing that requires two transfers (the indirect transfer from the transfer sheet to the printing target).

Embodiment 2

Another embodiment of the printing method according to the present invention is described below with reference to FIG. 2. For convenience of explanation, members having the same functions as those described in Embodiment 1 with reference to the accompanying drawing are given the same reference numerals, and explanations thereof will be omitted. The present embodiment will be described by focusing on primarily differences from Embodiment 1.

Figure 2:
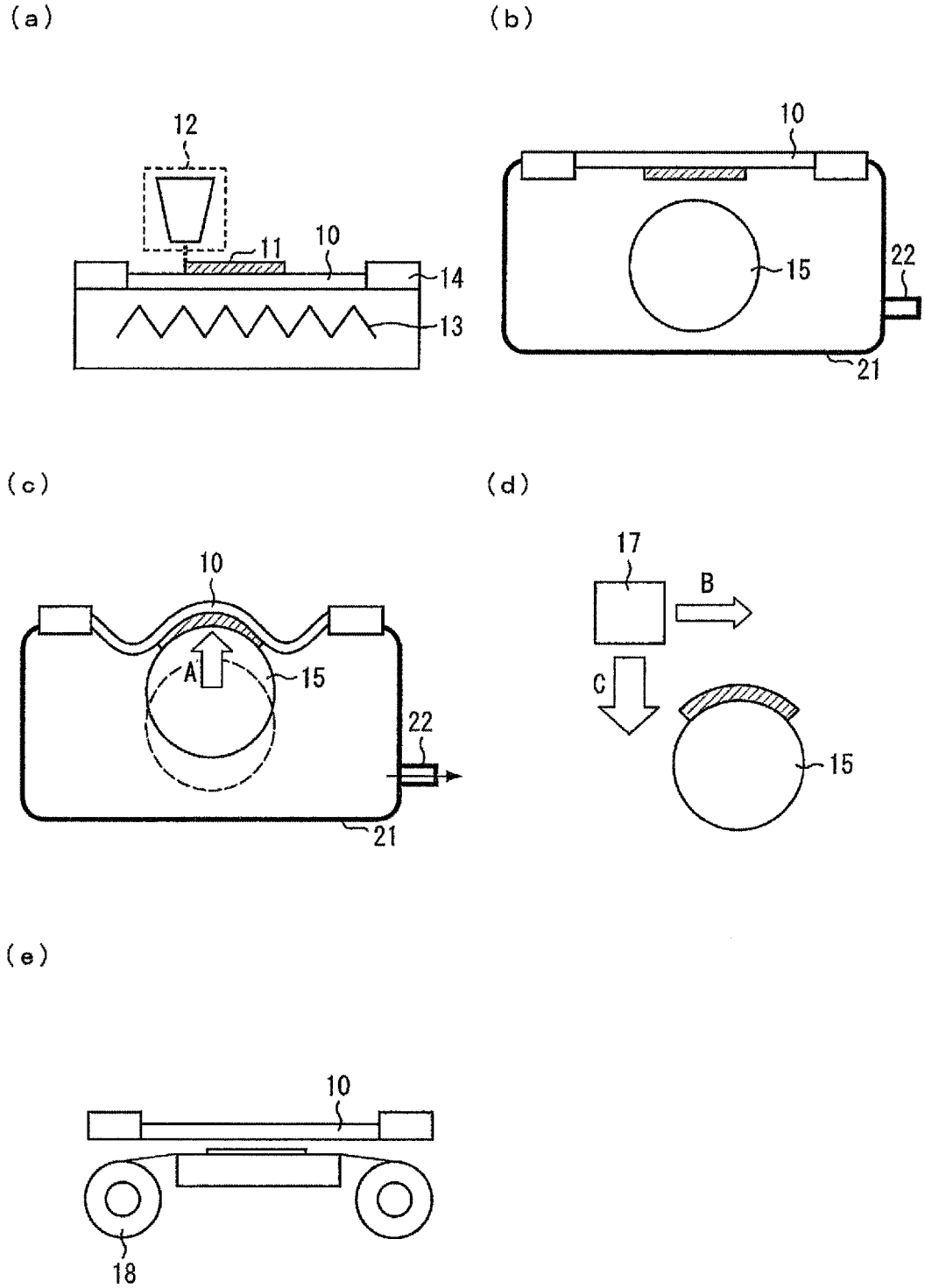
FIG. 2 is a diagram schematically representing a printing method according another embodiment of the present invention.

As illustrated in (a) in FIG. 2, the inkjet head 12 applies the UV curable ink onto the transfer sheet 10 fixed to maintain flatness with the holder 14 (applying step).

Thereafter, the heater 13 heats the ink to dry on the transfer sheet 10 by evaporating the solvent (heating and thickening step). As a result, the temporarily cured print image 11 is formed on the transfer sheet 10.

As illustrated in (b) of FIG. 2, the printing target 15 is housed in a vacuum chamber (housing) 21. The opening of the vacuum chamber 21 is then covered with the transfer sheet 10 oriented to place the temporarily cured print image 11 inside the vacuum chamber 21. Specifically, the holder 14 is set at the end of the opening. This seals the vacuum chamber 21. The vacuum chamber 21 has an outlet 22.

Thereafter, as illustrated in (c) of FIG. 2, the air inside the vacuum chamber 21 is released through the outlet 22 to create a reduced pressure inside the vacuum chamber 21. The reduced pressure bends the transfer sheet 10 inward into the vacuum chamber. On the other hand, the printing target 15 moves in the direction of arrow A, and contacts the transfer sheet 10. Upon contact, the temporarily cured print image 11 is transferred to the printing target 15 (transfer step). Alternatively, the shape of the vacuum chamber 21 may be adjusted in a manner that allows the transfer sheet 10 to contact the printing target 15 under the force of the air pressure applied to the transfer sheet 10 from outside of the vacuum chamber 21.

As illustrated in (d) of FIG. 2, the UV irradiator 17 is then moved in the direction of arrow B as it irradiates the temporarily cured print image 11 on the printing target 15 with ultraviolet light in the direction of arrow C. The irradiation cures the whole temporarily cured print image 11 on the printing target 15 (curing step).

For any subsequent printing, the cleaning sheet 18 is used to clean the transfer sheet 10, as illustrated in (e) of FIG. 2

An advantage of the present embodiment is the ease of control of transfer rate, as in Embodiment 1.

The present embodiment does not require fabrication of a printing plate, and can print on a variety of curved surfaces in small volumes, both quickly and at low cost. Further, because only a single transfer is required, less color misalignment and less bleeding occur in the transfer as compared to the conventional pad printing that requires two transfers (the indirect transfer from the transfer sheet to the printing target).

The present embodiment enables a direct transfer from the transfer sheet to the printing target without using the pad. Further, the method makes it easier to perform a transfer to a large-area printing target having large irregularities. This is made possible by the use of the atmospheric pressure, which makes it easier to more evenly apply pressure.

Embodiment 3

Yet another embodiment of the printing method according to the present invention is described below with reference to FIG. 3. For convenience of explanation, members having the same functions as those described in Embodiment 1 with reference to the accompanying drawing are given the same reference numerals, and explanations thereof will be omitted. The present embodiment will be described by focusing on primarily differences from Embodiment 1.

Unlike Embodiments 1 and 2, the present embodiment involves the indirect transfer from a transfer sheet 30 to the printing target 15. Specifically, the ink is transferred from the transfer sheet 30 to the pad 16, and to the printing target 15.

Figure 3:
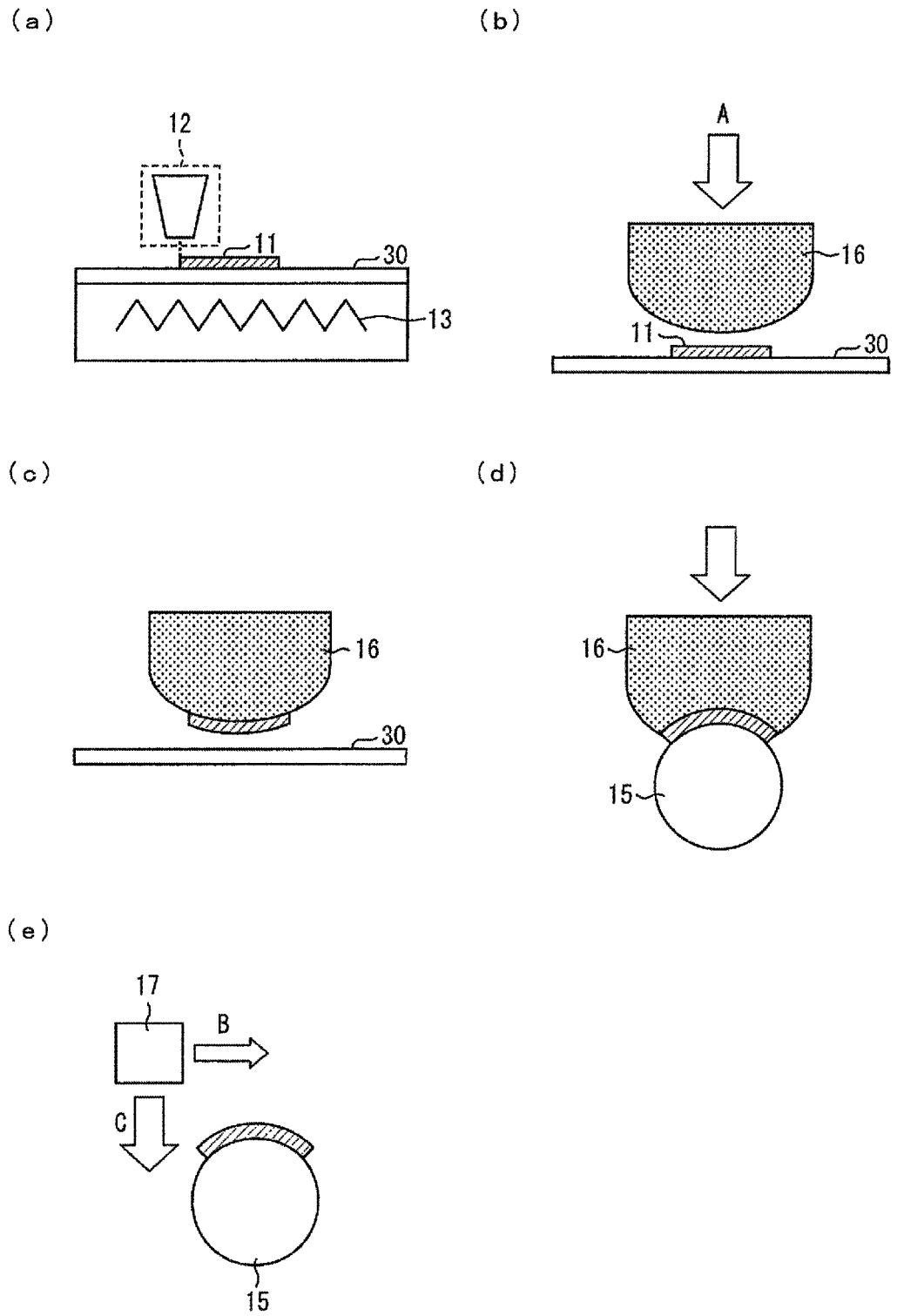
FIG. 3 is a diagram schematically representing a printing method according yet another embodiment of the present invention.

First, as illustrated in (a) of FIG. 3, the inkjet head 12 is used to apply the UV curable ink onto the transfer sheet 30 having a form of a plate (applying step). Unlike the transfer sheets 10 of Embodiments 1 and 2, the transfer sheet 30 has a form of a plate, and is not elastic, and is non-deformable along the shape of the printing target.

Thereafter, the heater 13 heats the ink to dry on the transfer sheet 30 by evaporating the solvent (heating and thickening step). As a result, the temporarily cured print image 11 is formed on the transfer sheet 30.

As illustrated in (b) of FIG. 3, the pad 16 is then moved in the direction of arrow A, and pressed against the temporarily cured print image 11 on the transfer sheet 30. As a result, the temporarily cured print image 11 transfers to the pad 16. FIG. 3, (c) depicts the state after the first transfer.

Thereafter, as illustrated in (d) of FIG. 3, the pad 16 is pressed against the printing target 15 in contact therewith to transfer the temporarily cured print image 11 to the printing target 15 under the applied pressure. For improved adhesion between the printing target 15 and the pad 16, the ink may be heated before or after being transferred to the pad 16.

Finally, as illustrated in (e) of FIG. 3, the UV irradiator 17 is moved in the direction of arrow B as it irradiates the temporarily cured print image 11 on the printing target 15 with ultraviolet light in the direction of arrow C. The irradiation cures the whole temporarily cured print image 11 on the printing target 15 (curing step).

Printing System

A printing system according to the present invention includes applying means that applies a curable resin-containing ink onto a transfer sheet, heating means that dries the ink on the transfer sheet to increase viscosity of the ink, transfer means that directly or indirectly transfers the ink on the transfer sheet to a printing target, and curing means that cures the ink on the printing target.

The inkjet head 12, the heater 13, the pad 16, and the UV irradiator 17 of Embodiment 1 are embodiments of the applying means, the heating means, the transfer means, and the curing means, respectively. That is, an embodiment of the printing system according to the present invention follows the descriptions of Embodiment 1 and FIG. 1.

Additional Remarks

As described above, an embodiment of the printing method according to the present invention includes an applying step of applying a UV curable resin-containing solvent-diluted ink onto the transfer sheet 10, a heating and thickening step of heating the ink on the transfer sheet 10 to increase viscosity of the ink, a transfer step of directly transferring the ink on the transfer sheet 10 to the printing target 15, and a curing step of curing the ink on the printing target 15. In this way, a stable, high-image-quality printing result can be obtained in digital pad printing that uses a UV ink or the like in multi-pass printing.

Further, because the UV curable ink contains a solvent, the ink viscosity can be increased by drying the ink and evaporating the solvent.

Preferably, the UV curable ink has a viscosity of 3 mPa·sec to 40 mPa·sec at 25° C. before the heating and thickening step. In this way, the ink can be desirably applied in the applying step without bleeding on the printing target 15.

Preferably, the heating and thickening step dries the ink by evaporating the solvent in the UV curable ink. In this way, the ink viscosity can be easily increased in the heating and thickening step.

Further, because the UV curable ink can be cured by irradiation of UV light in the curing step, the curing step can be easily performed by simply irradiating UV light.

Preferably, the transfer step directly transfers the ink by pressing the inked surface of the transfer sheet 10 against the printing target 15. The transfer rate can easily be controlled according to this embodiment. Further, because fabrication of a printing plate is not required, a variety of curved surfaces can be printed in small volumes, both quickly and at low cost. Further, because only a single transfer is required, less color misalignment and less bleeding occur in the transfer as compared to the pad printing that requires two transfers. Preferably, the transfer sheet 10 is pressed with the pad 16 from the opposite side of the inked surface. Efficient transfer is possible by applying pressure with the pad 16.

Preferably, the transfer sheet 10 is deformable along the shape of the printing surface of the printing target 15. In this way, the printing target can be selected from a variety of shapes.

The transfer sheet 10 is preferably a silicon-based rubber, more preferably a silicon rubber. In this way, the printing target 15 can be selected from a variety of shapes.

Preferably, the pad 16 has elasticity. The pad 16 is not limited to rubber, and may be of shapes or materials that can deform along the irregularities, and exert certain pressure. For example, a balloon-like bag filled with air or liquid, or a sponge may be used to apply pressure for the transfer. In this way, the printing target can be selected from a variety of shapes.

The transfer sheet 10 may have elasticity, and the transfer step may include:

placing the transfer sheet 10 after the heating and thickening step in the vacuum chamber 21 having the outlet 22, or installing the transfer sheet 10 after the heating and thickening step to cover an opening of the vacuum chamber 21 when the vacuum chamber 21 has an opening other than the outlet 22;

placing the printing target 15 inside the vacuum chamber 21; and sucking air inside the vacuum chamber 21 through the outlet 22 to create a reduced pressure inside the vacuum chamber 21, and contact and transfer the transfer sheet 10 to the printing target 15.

This makes it easier to control the transfer rate. Further, fabrication of a printing plate is not required, and a variety of curved surfaces can be printed in small volumes, both quickly and at low cost. Further, because only a single transfer is required, less color misalignment and less bleeding occur in the transfer as compared to the pad printing that requires two transfers. Further, the direct transfer from the transfer sheet 10 to the printing target 15 is possible without using the pad 16 of Embodiment 1. Further, it becomes easier to perform a transfer to a large-area printing target having large irregularities. This is made possible by the use of the atmospheric pressure, which makes it easier to more evenly apply pressure.

The transfer step may be adapted to indirectly transfer the ink from the transfer sheet 10 to the printing target 15 by pressing the pad 16 against the transfer sheet 10 after the heating and thickening step to transfer the ink to the pad 16, and then pressing the pad 16 against the printing target 15 to transfer the ink. By transferring the ink to the pad 16, and to the printing target 15, a stable, high-image-quality printing result can be obtained in multi-pass inkjet digital pad printing.

An embodiment of the printing system according to the present invention includes the inkjet head 12, the heater 13, the pad 16, and the UV irradiator 17. In this way, a stable, high-image-quality printing result can be obtained in offset printing that uses a UV curable ink in multi-pass printing.

As described above, it is preferable in the printing method according to the present invention that the ink contain the curable resin and a solvent.

With this configuration, the ink viscosity can be increased by drying the ink and evaporating the solvent.

It is preferable in the printing method according to the present invention that the ink have a viscosity of 3 mPa·sec to 40 mPa·sec at 25° C. before the heating and thickening step.

With this configuration, the ink can be desirably applied in the applying step without bleeding on the printing target.

It is preferable in the printing method according to the present invention that the heating and thickening step dry the ink by evaporating the solvent in the ink.

With this configuration, the ink viscosity can be easily increased in the heating and thickening step.

It is preferable in the printing method according to the present invention that the curable resin be a ultraviolet curable resin, and that the curing step irradiate the ink with UV light.

With this configuration, the curing step can be easily performed by simply irradiating UV light.

It is preferable in the printing method according to the present invention that the transfer step directly transfers the ink by pressing the inked surface of the transfer sheet against the printing target.

With this configuration, the transfer rate can be controlled more easily. Further, fabrication of a printing plate is not required, and a variety of curved surfaces can be printed in small volumes, both quickly and at low cost. Further, because only a single transfer is required, less color misalignment and less bleeding occur in the transfer as compared to the pad printing that requires two transfers.

It is preferable in the printing method according to the present invention that the transfer sheet be pressed with a flexible pressing member, such as a pad, from the opposite side of the inked surface.

With this configuration, the ink can be more efficiently transferred by the applied pressure of the pressing member, or the pad.

It is preferable in the printing method according to the present invention that the transfer sheet be deformable along the shape of the printing surface of the printing target. Preferably, such deformation occurs at room temperature or under applied heat.

With this configuration, the printing target can be selected from a variety of shapes.

It is preferable in the printing method according to the present invention that the transfer sheet be a silicon rubber that contains a silicon component.

With this configuration, the printing target can be selected from a variety of shapes.

It is preferable in the printing method according to the present invention that the pad have elasticity. Preferably, the pad also has flexibility.

With this configuration, the printing target can be selected from a variety of shapes.

The printing method according to the present invention may be adapted so that the transfer sheet has elasticity, and that the transfer step includes:

placing the transfer sheet after the heating and thickening step in a housing having an outlet, or installing the transfer sheet after the heating and thickening step to cover a housing opening when the housing has an opening other than the outlet;

placing the printing target inside the housing in advance; and sucking air inside the housing through the outlet to create a reduced pressure inside the housing, and contact and transfer the transfer sheet to the printing target.

Note that "elasticity" means flexibility, or elasticity such as thermoplasticity at ordinary temperature or under heat.

With this configuration, fabrication of a printing plate is not required, and a variety of curved surfaces can be printed in small volumes, both quickly and at low cost. Further, because only a single transfer is required, less color misalignment and less bleeding occur in the transfer as compared to the pad printing that requires two transfers. Further, the transfer method under reduced pressure makes it easier to perform a transfer to a large-area printing target having large irregularities. This is made possible by the use of the atmospheric pressure, which makes it easier to more evenly apply pressure.

The printing method according to the present invention may be adapted so that the transfer step includes pressing a pad against the transfer sheet after the heating and thickening step to transfer the ink to the pad; and pressing the pad against the printing target to indirectly transfer the ink from the transfer sheet to the printing target.

With this configuration, by transferring the ink to the pad, and to the printing target, a stable, high-image-quality printing result can be obtained in multi-pass digital pad printing.

The present invention is not limited to the description of the embodiments above, but may be altered in many ways within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is applicable to the field of printing such as multi-pass printing.

REFERENCE SIGNS LIST

10, 30: Transfer sheet
11: Temporarily cured print image
12: Inkjet head (applying means)
13: Heater (heating means)
15: Printing target
16: Pad (pressing member, transfer means)
17: UV irradiator (curing means)
21: Vacuum chamber (housing)
22: Outlet

The invention claimed is:

1. A printing method comprising:

an applying step of applying an ink containing a curable resin and a solvent onto a first surface of a transfer sheet, wherein the transfer sheet is elastically deformable along a shape of a printing surface of a printing target;

a heating and thickening step of heating the ink on the transfer sheet to increase viscosity of the ink, wherein the heating and thickening step comprises a step of evaporating the solvent from a first surface of the ink to be in contact with the printing target to result a viscosity gradient in the ink, such that the viscosity is higher at the first surface of the ink than at a second surface of the ink in contact with the transfer sheet, and wherein the heating and thickening step further comprises a step of directly heating a second surface of the transfer sheet, which is opposite to the first surface of transfer sheet;

a transfer step of directly or indirectly transferring the ink on the transfer sheet to the printing target after the viscosity gradient in the ink is resulted, wherein the transfer step comprises a step of pressing the first surface of the transfer sheet on the printing target using a pressing member, and the pressing member and the transfer sheet are elastically deformed along the shape of the printing surface of the printing target while the transfer sheet is pressed; and a curing step of curing the ink on the printing target.

2. The printing method according to claim 1, wherein the ink has a viscosity of 3 mPa·sec to 40 mPa·sec at 25° C. before the heating and thickening step.

3. The printing method according to claim 1, wherein the curable resin is a ultraviolet curable resin, and wherein the curing step irradiates the ink with ultraviolet light.

4. The printing method according to claim 1, wherein the transfer sheet is a silicon rubber.

5. The printing method according to claim 1, wherein the transfer sheet has elasticity, and wherein the transfer step includes:

placing the transfer sheet after the heating and thickening step in a housing having an outlet, or installing the transfer sheet after the heating and thickening step to cover a housing opening when the housing has an opening other than the outlet;

placing the printing target inside the housing in advance; and sucking air inside the housing through the outlet to create a reduced pressure inside the housing, and contact and transfer the transfer sheet to the printing target.

6. The printing method according to claim 1, wherein the transfer step includes:

pressing a pressing member against the transfer sheet after the heating and thickening step to transfer the ink to the pressing member; and pressing the pressing member against the printing target to indirectly transfer the ink from the transfer sheet to the printing target.

7. A printing system comprising:

applying means that applies an ink containing a curable resin and a solvent onto a first surface of a transfer sheet, wherein the transfer sheet is elastically deformable along a shape of a printing surface of a printing target;

heating means that heats the ink on the transfer sheet to increase viscosity of the ink, wherein the heating means evaporates the solvent from a first surface of the ink to be in contact with the printing target to result a viscosity gradient in the ink, such that the viscosity is higher at the first surface of the ink than at a second surface of the ink in contact with the transfer sheet, and wherein the heating means directly heats a second surface of the transfer sheet, which is opposite to the first surface of transfer sheet;

transfer means that directly or indirectly transfers the ink on the transfer sheet to the printing target after the viscosity gradient is resulted, wherein the transfer means comprises a pressing member pressing the first surface of the transfer sheet on the printing target, and the pressing member and the transfer sheet are elastically deformed along the shape of the printing surface of the printing target while the transfer sheet is pressed; and curing means that cures the ink on the printing target.

8. The printing method according to claim 1, wherein the transfer step is performed in a heated environment.

9. The printing method according to claim 7, wherein transfer means transfers the ink on the transfer sheet to the printing target in a heated environment.

* * * * *